United States Patent [19]

Klapp

[11] 4,249,360

[45] Feb. 10, 1981

[54] TRANSPORT APPARATUS FOR A CARTON FILLING MACHINE

[75] Inventor: Hartmut Klapp, Kaarst, Fed. Rep. of Germany

[73] Assignee: Jagenberg-Werke AG, Dusseldorf, Fed. Rep. of Germany

[21] Appl. No.: 22,139

[22] Filed: Mar. 20, 1979

[30] Foreign Application Priority Data

Jun. 12, 1978 [DE] Fed. Rep. of Germany ..... 2825646

[51] Int. Cl.[3] ..... B65B 5/10; B65B 39/12; B65G 23/04

[52] U.S. Cl. ..... 53/244; 53/251; 53/259; 198/339; 198/858

[58] Field of Search ..... 53/244, 249, 250, 251, 53/259, 534

[56] References Cited

U.S. PATENT DOCUMENTS

| | | | |
|---|---|---|---|
| 3,000,161 | 9/1961 | Horgan | 53/244 |
| 3,193,089 | 7/1965 | Williams | 198/858 |
| 3,585,782 | 6/1971 | Staley | 53/249 X |
| 3,932,982 | 1/1976 | Klapp | 53/244 |

*Primary Examiner*—Horace M. Culver

*Attorney, Agent, or Firm*—Sughrue, Rothwell, Mion, Zinn and Macpeak

[57] ABSTRACT

The invention relates to transport apparatus for transport containers in the area where blanks are loaded into a transport container of a carton filling machine. A plurality of first free-wheeling transport rollers are provided in the loading area and a plurality of rollers outside the loading area which are driven by a drive belt. The drive belt is raised to pass over a first diverting roller at the beginning of the loading area then returned at the end of the loading area by passing over a second diverting roller. A second free-wheeling transport roller is provided which is movable into and out of engagement with the drive belt.

5 Claims, 3 Drawing Figures

TRANSPORT APPARATUS FOR A CARTON FILLING MACHINE

BACKGROUND OF THE INVENTION

Carton filling machines of the general type to which the invention pertains are used to fill transport container cartons in which the blanks are placed into the carton with the aid of a lowering and pivoting rail mechanism which moves within the carton. The lowering and pivoting rail mechanism travels to one wall of the carton which is pressed outward by the continuous loading of the blanks. The carton can be moved in the direction of filling on free-wheeling transport rollers. If more than one layer is to be loaded into the carton, it is necessary, after removing the lowering and pivoting rail mechanism, to move the carton back into a position to receive the new layer.

SUMMARY OF THE INVENTION

A basic object of the invention is the provision of a transport apparatus of the above-mentioned type in which the transport container is repositioned for the beginning of a new layer in a simple and reliable manner.

This object is met according to the invention wherein a drive belt, which runs beneath the driven rollers outside of the loading area, is raised at the beginning of the loading area so as to pass over a first diverting roller and is returned by a second diverting roller at the end of the loading area. In close proximity to the second diverting roller, a free-wheeling reverse transport roller is provided which is normally out of engagement with the drive belt and is arranged therebeneath. This free-wheeling transport roller can be moved into engagement with the drive belt.

The drive belt which runs beneath the driven rollers outside of the loading area must be adapted for continued transport of the transport container after filling which in turn requires diversion of the belt. In the transport apparatus of the invention, the drive belt, which must be provided in any case and which is continually in motion, is also used to effect the reverse transport of the transport container for the beginning of a new layer.

The reverse transport roller may be moved into engagement with the drive belt with the aid of an electromagnet. This makes possible rapid and precise engagement of the reverse transport roller.

It is advantageous to provide the reverse transport roller in the area beneath the lowering and pivoting rail mechanism which moves into the transport container to load blanks therein so as to assure a sufficient reverse transport range.

In loading multiple rows of blanks into the transport container, it is also advantageous to arrange for the reverse transport roller to be capable of engagement with the drive belt only after a lateral shifting of the transport container.

Finally, the transport apparatus according to the invention is formed to avoid damage to the lowering and pivoting rail mechanism, that is the reverse transport roller can only be moved into engagement with the drive belt after the lowering and pivoting rail arrangement for the loading of the blanks has moved out of the transport container.

BRIEF DESCRIPTION OF THE DRAWINGS

An exemplary embodiment of the invention is illustrated in the drawings and will be described in greater detail below.

DESCRIPTION OF THE PREFERRED EMBODIMENTS

Figure 1:
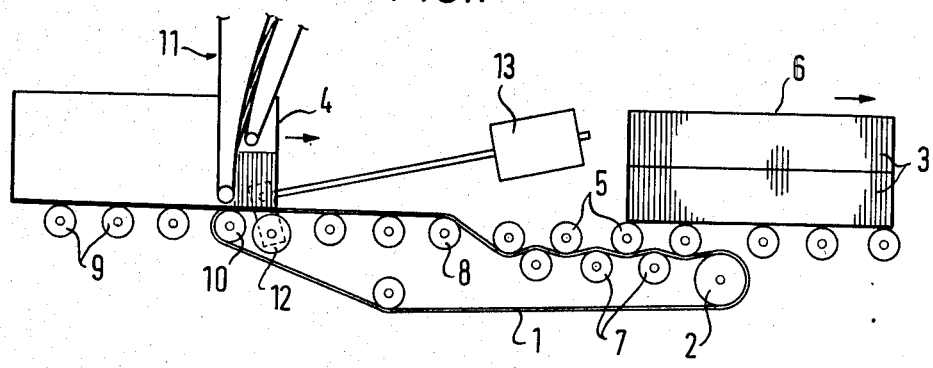
FIG. 1 is a schematic side view of the transport apparatus according to the invention at the beginning of the loading of blanks into a transport container.

The transport apparatus shown in the drawings has a drive belt which is driven by a drive roller 2. In the area outside of the loading area for blanks 3 into a transport container formed as a carton 4, drive belt 1 runs beneath transport rollers 5 in a direction such that transport rollers 5 remove a full carton 6 from the loading area as soon as it is engaged thereby. Drive belt 1 is held against transport rollers 5 by support rollers 7.

Drive belt 1 is guided over a first diverting roller 8 at the beginning of the loading area, having no contact with free-wheeling transport rollers 9 in the loading area. At the end of the loading area, drive belt 1 is returned by means of a second diverting roller 10.

In the vicinity of second diverting roller 10 and a lowering and pivoting rail mechanism 11 for loading blanks 3 into the carton 4, one of free-wheeling transport rollers 9 acts as a reverse transport roller 12 which can be moved into engagement with drive belt 1.

An electromagnet 13 is provided to move reverse transport roller 12 into engagement with drive belt 1. As soon as electromagnet 13 is activated, reverse transport roller 12 is raised and brought into contact with drive belt 1. In this manner, reverse transport roller 12 is rotated in the direction of the arrow shown in FIG. 2, whereby carton 4 is brought into position for loading of a further layer of blanks 3.

The activation of electromagnet 13 takes place when the lowering and pivoting rail mechanism 11 has been moved out of carton 4 thus serving to protect the lowering and pivoting rail mechanism 11.

In loading multiple rows of blanks 3, carton 4 must also be moved laterally relative to free-wheeling transport rollers 9. This lateral movement should take place before electromagnet 13 is activated for the reverse transport of carton 4.

Figure 2:
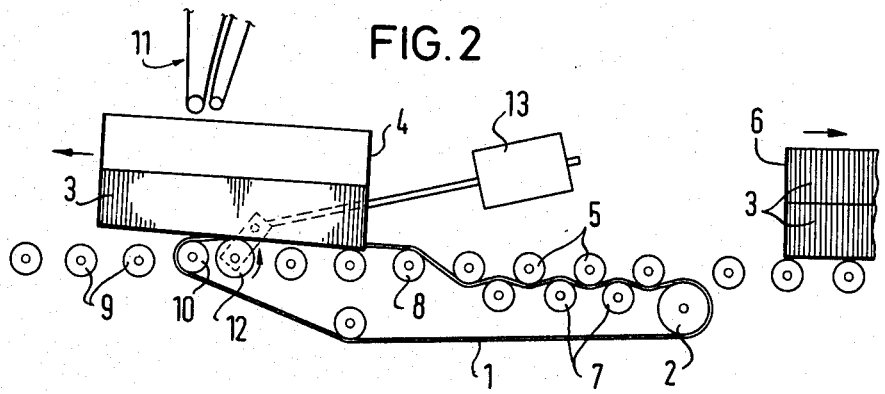
FIG. 2 is a side view similar to FIG. 1 during reverse transport of a partially filled transport container.
Figure 3:
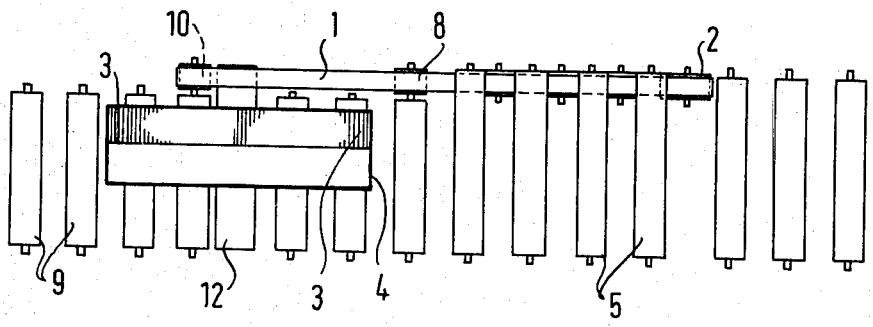
FIG. 3 is a schematic top view of the transport apparatus at the beginning of the reverse transport of a transport container with multiple rows of blanks.

FIGS. 1 and 2 of the drawings respectively illustrate a carton 4 during filling and reverse transport as well as a full carton 6 being transported in the direction indicated by the arrow. In FIG. 3, only a partially filled carton 4 is shown which has already been laterally shifted and is being brought into position for the loading of a further layer or row of blanks 3.

What is claimed is:

1. Transport apparatus for transport containers in the area of a carton filling machine where blanks are placed in the transport containers, comprising:

a plurality of first free-wheeling transport rollers in a loading area;

first and second diverting rollers;

a plurality of rollers outside said loading area which are driven by means of a drive belt;

said drive belt being positioned outside the loading area and running under the driven rollers, said drive belt being raised to pass over said first diverting roller at the beginning of said loading area and then being returned at the end of the loading area by passing over said second diverting roller; and a second free-wheeling reverse transport roller in close proximity to said second diverting roller, said free-wheeling reverse transport roller being normally not in contact with the drive belt and being arranged beneath said drive belt and being movable into engagement with said drive belt, and slightly above said plurality of freewheeling rollers.

2. The transport apparatus according to claim 1, further comprising an electromagnet for moving said reverse transport roller into contact with said drive belt.

3. The transport apparatus according to claim 1, further comprising a lowering and pivoting rail mechanism which moves into a transport container to load the blanks therein, said reverse transport roller being positioned in an area beneath said lowering and pivoting rail mechanism.

4. The transport apparatus according to any of claims 1 to 3, wherein in loading multiple rows of blanks into a transport container, said reverse transport roller is prevented from being moved into engagement with the drive belt until said transport container has been shifted laterally.

5. The transport apparatus according to any of claims 1 to 3, wherein said reverse transport roller is prevented from being moved into engagement with said drive belt until said lowering and pivoting mechanism moves out of said transport container.

* * * * *